United States Patent [19]

Schreiber et al.

[11] Patent Number: 4,897,122

[45] Date of Patent: Jan. 30, 1990

[54] PROCESS, COMPOSITION AND APPARATUS FOR CLEANING VENETIAN BLINDS

[76] Inventors: A. Charles Schreiber, 114 Edgemont Rd., Watchung, N.J. 07060; Robert W. Schreiber, 612 Orchard St., Cranford, N.J. 07076

[21] Appl. No.: 171,161

[22] Filed: Mar. 21, 1988

Related U.S. Application Data

[63] Continuation of Ser. No. 895,500, Aug. 11, 1986, abandoned.

[51] Int. Cl.[4] ..... B08B 3/02

[52] U.S. Cl. ..... 134/29; 134/9; 134/254; 134/28

[58] Field of Search ..... 134/2, 9, 15, 25.4, 134/26, 28, 29; 252/558

[56] References Cited

U.S. PATENT DOCUMENTS

| | | | |
|---|---|---|---|
| 2,199,747 | 5/1940 | Long et al. | 134/9 |
| 2,273,514 | 2/1942 | Chamberlin | 15/77 |
| 2,279,691 | 4/1942 | Long et al. | 15/77 |
| 2,282,628 | 5/1942 | Whann et al. | 15/77 X |
| 2,713,011 | 7/1955 | Durst | 134/15 |
| 3,481,877 | 12/1969 | Moll | 134/2 X |
| 3,481,881 | 12/1969 | Wedell | 134/28 X |
| 3,643,277 | 2/1972 | Durst | 15/77 |
| 3,699,047 | 10/1972 | Petrey, Jr. | 134/2 X |
| 3,766,077 | 10/1973 | Hwa et al. | 134/2 X |
| 3,887,497 | 6/1975 | Ulvild | 134/2 X |
| 3,892,004 | 7/1975 | Downs | 15/102 |
| 4,227,938 | 10/1980 | Fowler | 134/29 |
| 4,284,434 | 8/1981 | Lingmann et al. | 134/2 |
| 4,599,116 | 7/1986 | King et al. | 134/29 |
| 4,642,834 | 2/1987 | Suzuki | 15/21 R |
| 4,683,008 | 7/1987 | Betts | 134/29 |

OTHER PUBLICATIONS

Chem. Abst. p. 131, vol. 102, 1985, 26,902v, Cleaning of Oil Stained Fabrics.

Chem. Abst., p. 118, vol. 98, 1983, 217679m, Washing and Stain Removing Agent for Textiles.

Jenny Multi-Job 1000 All Electric Pressure Washer, Jenny Division; Homestead Industries, Coraopolis, Pa.

*Primary Examiner*—Asok Pal

*Attorney, Agent, or Firm*—Thomas D. Hoffman

[57] ABSTRACT

A mobile vehicle containing apparatus and process for on-site cleaning of venetian blinds, and an aqueous spray solution, process and apparatus for eliminating water spots from the washed and rinsed venetian blinds are described.

13 Claims, 1 Drawing Sheet

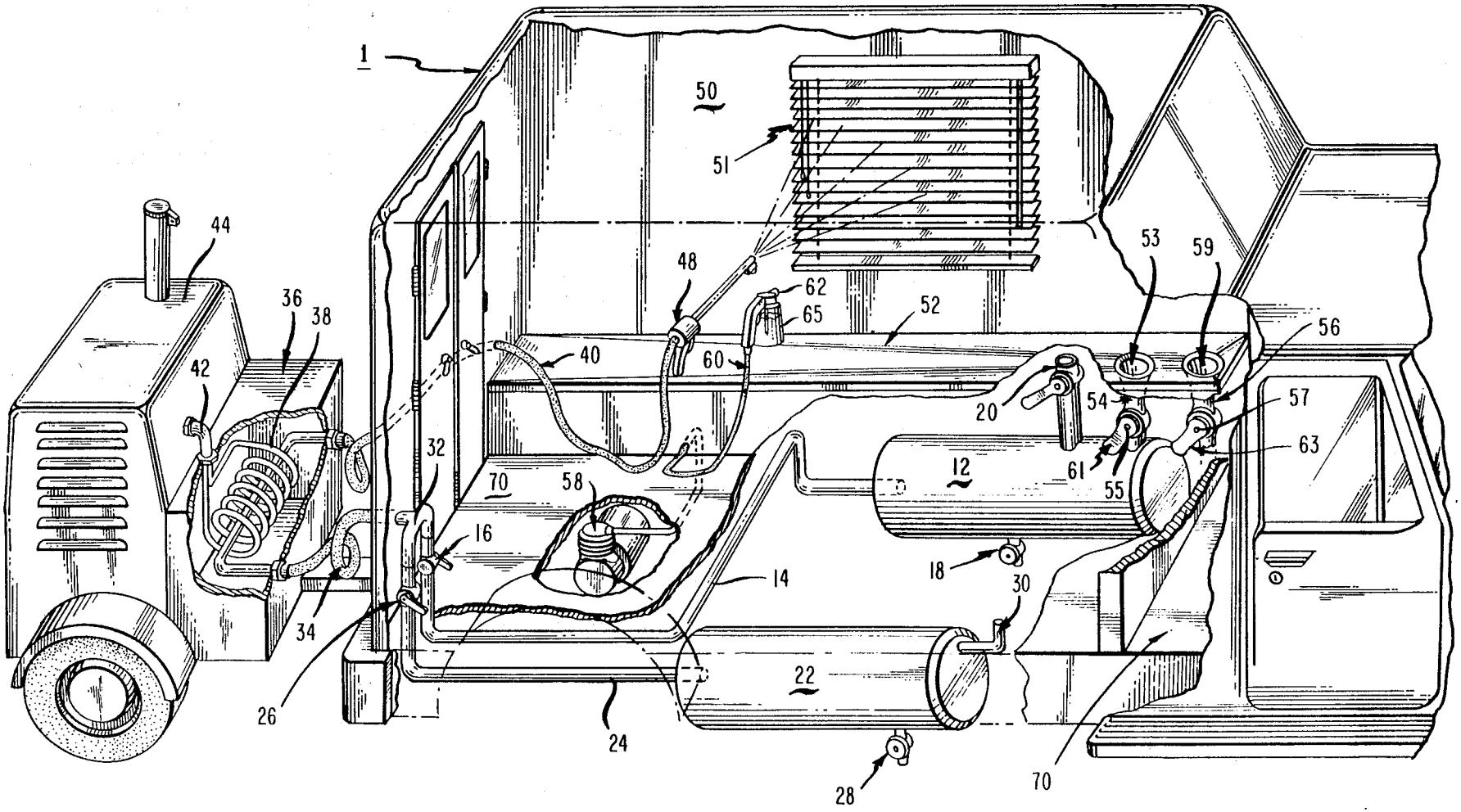
1
12
14
16
18
20
22
24
26
28
30
32
34
36
38
40
42
44
48
50
51
52
53
54
55
56
57
58
59
60
61
62
63
65
70
70

PROCESS, COMPOSITION AND APPARATUS FOR CLEANING VENETIAN BLINDS

This is a continuation of application Ser. No. 895,500 filed 08/11/86, now abandoned.

BACKGROUND

This invention relates to a process using an aqueous spray solution for treating and cleaning venetian blinds and apparatus for carrying out the process.

More specifically, this invention relates to a process and composition for treating venetian blinds to eliminate water spots after cleaning them and an apparatus for cleaning such venetian blinds that is adapted to operate in an enclosed mobile vehicle, e.g., a panel truck or van, enabling the cleaning apparatus to be transported to the work site so the process can be carried out.

The so-called venetian type blind is normally constructed of a plurality of rotatable and reversible slats that can be positioned in open spaced relationship or closed in overlapping contact. The slats may be constructed of metal, e.g. aluminum, plastic ("vinyl"), baked enamel paint-coated metal or fabric and be suspended vertically or horizontally. When the slats become soiled in use from dust, smoke or grease and like foreign matter, it is a difficult and tedious task to wash them by the usual hand method.

U.S. Pat. Nos. 2,199,747 and 2,279,691 disclose a method and apparatus for washing venetian blinds on a predetermined track.

U.S. Pat. No. 3,892,004 discloses a hand-held apparatus for cleaning venetian blinds which utilizes a pair of contiguously mounted slat-cleaning elements mounted on rotatable hollow shafts projecting from a housing. Cleaning solution is dispensed from the slat-cleaning elements which are normally cylindrical sponges.

U.S. Pat. No. 3,643,277 discloses a machine for cleaning slats of venetian blinds which utilizes feed rollers, rotating brushes and a sprayer for liquid material.

Normally, soiled venetian blinds are removed from the windows of a building and transported to a remote facility where they are cleaned, e.g. washed and dried.

This process requires two to three days during which time the benefits of the venetian blinds are not available to their owner.

A mobile unit to wash soiled venetian blinds utilizing sonic cleaning has been developed. However, sonic cleaning of the newer venetian blinds containing vinyl plastic or baked enamel paint-coated metal slats leaves a coating of water droplets which dry to produce an unacceptable stained surface on the slats.

In addition, generally, when venetian blinds are washed, some of the washing solution deposits on the slats as droplets and during drying, leave spots on the slats.

There is thus a need for a composition which can be applied to venetian blind slats during washing or after drying to prevent the deposition of water spots thereon. There is also a need for an apparatus, especially a mobile apparatus which employs a method to clean thoroughly all types of venetian blinds.

SUMMARY OF THE INVENTION

This invention provides a process for washing venetian blinds and for preventing formation of water droplets on them or removing water droplets after the slats are washed, thus preventing the formation of stains on the washed surfaces.

Although all venetian blind surfaces which do not absorb water or washing liquids are suitable to be washed by the process of this invention, vinyl plastic or baked enamel paint-coated metal slats are preferred.

The process comprises directing sufficient amount of an aqueous solution comprising an alkali metal ($C_8$–$C_{14}$)alkylbenzene sulfonate and at least one ethoxylated nonylphenol onto the surfaces of washed and rinsed venetian blind slats in an amount sufficient to remove or prevent substantially all water beads from forming on their surfaces.

The present invention also provides a process for cleaning venetian blinds having dirt adhering to the surfaces thereof which comprises:

(a) washing the surfaces of the venetian blinds with an aqueous detergent solution by spraying an amount of and at a temperature and pressure sufficient to transfer substantially all the dirt from the surfaces thereof to said aqueous detergent solution;

(b) rinsing the washed venetian blinds from step (a) with water in an amount and at pressure sufficient to remove substantially all the aqueous detergent solution from the surfaces of the venetian blinds;

(c) directing onto the surfaces of the washed and rinsed venetian blinds from step (b) sufficient amount of an aqueous spray solution comprising an alkali metal ($C_8$–$C_{14}$)alkylbenzene sulfonate and at least one ethoxylated nonylphenol to remove substantially all water droplets from the surface of said washed and rinsed venetian blinds from step (b); and (d) drying the washed and rinsed venetian blinds.

The present invention further provides an apparatus for cleaning dirty venetian blinds which comprises:

a four-sided enclosed portion of a mobile vehicle wherein the enclosed portion is substantially box shaped with three walls and a doorway wherein two of the walls are substantially parallel to and opposite each other and the third wall connects first perpendicular ends of the two substantially parallel walls and is opposite to and substantially parallel to the doorway which connects second ends of the two substantially parallel walls, a ceiling and a floor, wherein;

(1) the inside of one of said parallel walls is adapted to hold said venetian blinds as they are being washed and rinsed (the wash wall);

(2) a flexible pressure hose for dispensing the aqueous detergent solutions for washing or water for rinsing said venetian blinds, said hose having two ends, one end of which having an adjustable nozzle and the second end of which having means to draw either aqueous detergent wash solution from a detergent holding tank attached to the underside of the floor of the enclosed portion of the mobile vehicle or to draw rinse water from a rinse water holding tank attached to the underside of the said floor;

(3) heating means intermediate the ends of said pressure hose for heating a solution passing through said hose;

(4) means at the inside on the ceiling or attached to said wash wall adapted to hold said venetian blinds;

(5) means at the bottom of said wash wall adapted for recycling the said aqueous detergent wash solution into said detergent holding tank;

(6) means at the bottom of said wash wall, separate from said recycling means, for draining used rinse water from said vehicle; and (7) means to power said heating means and said pressure hose.

In a preferred embodiment of the invention, there are means on the inside ceiling of the enclosed portion for hanging a plurality of wet, washed venetian blinds so they can be dried. Drying means is also in the enclosed portion of the vehicle separated from the wash and rinse portion by a removable screening means.

BRIEF DESCRIPTION OF THE FIGURE

The FIGURE is a schematic representation of the washingrinsing apparatus according to this invention.

DETAILED DESCRIPTION

The process and composition of this invention is useful for eliminating water spots from articles which have been washed and which are being rinsed or after they are rinsed using apparatus of this invention. Articles most amenable to being treated after washing according to this invention are plastic or baked enamel paint coated articles such as venetian blinds or similar structures. In addition, other articles such as dishes, walls, countertops, furniture and the like can be treated successfully to eliminate water spots.

In its process aspect, in a preferred embodiment, venetian blinds or similar article with slats are washed and rinsed, as described hereinafter, then, by means of a conventional spray hose with a nozzle similar to a conventional lawn hose or sprayer with tank used to dispense agricultural chemicals, e.g. insecticides, herbicides and the like, are sprayed with an aqueous solution comprising an alkali metal ($C_8$–$C_{14}$)alkylbenzene sulfonate and at least one ethoxylated nonylphenol.

The specific structure of the spraying apparatus is not part of this invention, the only criteria are that it be able to spray the item with water droplets without injuring the item or nearby structures.

The concentrations and relative amounts of each of the components of the aqueous spray solution are not critical so long as they are present in concentrations and relative amounts sufficient to eliminate the water droplets when sprayed thereon.

It is also possible to add the preceding aqueous spray solution to the rinse water to eliminate the droplets that may form on the washed surfaces.

As used herein, "alkali metal" means a metal of Group Ia of the Periodic Table of Elements, e.g. sodium, potassium, lithium, rubidium and cesium, preferred are sodium or potassium. "Alkyl" means straight and branched chain saturated hydrocarbons of from 8 to 14 carbon atoms, such as, nonyl, decyl, iso-decyl, n-, iso- and sec-undecyl, n-, sec-, and iso-dodecyl, n-, iso- and sec-tridecyl, n-, iso- and sec-tetradecyl and the like.

The preferred alkali metal ($C_8$–$C_{14}$)alkylbenzene sulfonate for use in this invention is sodium dodecylbenzene sulfonate which is commercially available from Stepan Company, Northfield, Illinois.

The term "ethoxylated nonylphenyl" means polyethylene glycols mono nonylphenyl ethers represented by the formula $$C_9H_{19}—C_6H_4—(OCH_2)_nOH$$

wherein n is the average number of ethylene oxide units. Ethoxylated nonylphenols having values of n from 1 to 100 are commercially available. Ethoxylated nonylphenols found particularly useful in the process of the present invention have values of n from 8 to 14, with 12 being preferred.

In a preferred aspect of the present invention, sodium dodecylbenzene sulfonate (available as a 35 weight percent aqueous solution from Stepan Co. as BIO-Soft D-35x®) and ethoxylated nonylphenol having n equal to 12 (available from Stepan Co. as MAKON®-12) are mixed together in a weight ratio of about 1 to 1 to about 3:1. The mixtures so formed are diluted with water to form about 10 weight percent aqueous solutions having a pH of about 7 to 7.5. Generally, only about one to two ml (one to two eyedroppers full) of the aqueous solution of sodium dodecylbenzene sulfonate and ethoxylated nonylphenol is added to about one liter of water conveniently contained in the reservoir of a hand held sprayer which may be electrical- or air-powered. The water droplets typically occur on the surfaces of vinyl plastic and baked enamel paint-coated metal slats. The diluted aqueous solution of sodium dodecylbenzene sulfonate and ethoxylated nonyl phenol now containing more than about 99 weight percent water is directed at those areas of the venetian blind surfaces having water droplets, causing the water droplets to be eliminated, so that upon drying, the surfaces do not have water spots.

The term "aqueous detergent solution" as used herein means an aqueous solution of 0.5 to 5 weight percent of a surfactant, especially a non-ionic surfactant such as the ethoxylated nonylphenols described hereinabove. In a preferred aspect of the present invention, a solution of water and about 1.5 to 2.0, more preferably 1.8 weight percent of an ethoxylated nonylphenol wherein n is about 9.5 is used.

The temperature and pressure of the aqueous detergent solution should be high enough to remove the dirt but not so high as to damage the venetian blind surfaces or nearby surfaces. In a preferred aspect of the present invention, the temperature of the aqueous detergent solution is about 50 degrees F. to 100 degrees F. above the temperature of cold tap water; the pressure of the aqueous detergent solution is at least about 800 psi, preferrebly about 800 to 1000 psi. In a preferred aspect of the present invention, a hot pressure washer equipped with a heating coil and pump and hand held nozzle gun, for example, a JENNY Model MJ-1000 available from JENNY Division, Homestead Industries Box 348, Coraopolis, PA. 15108, is used.

The washing and rinsing process and apparatus of the present invention can be better described by referring to the FIGURE. The invention is carried out in an enclosed mobile vehicle such as a truck as illustrated in the FIGURE.

An aqueous detergent storage tank 12 under the floor 70 of the enclosed portion 1 of the truck equipped with a fill inlet 18 and a breathing tube 20 is connected to a pressure washer 36 with a heating coil 38 via a line 14 leading from the detergent tank 12 through a fitting 32 to a line 34 leading to a pressure washer 36, said line 14 having a containing valve 16. A rinse tank 22 under the floor 70 of the enclosed portion 1 of the truck equipped with a fill inlet 28 and a breathing tube 30 which is connected to the pressure washer 36 through a line 24 and its containing valve 26 and through said line 34. The line 14 from the valve 16 and the line 24 from the valve 26 meet at a three way fitting 32 with the line 34 which leads to the pressure washer tank 36 containing a heating coil 38. The line 40 is connected at one end to the pressure washer tank 36 and at the other end to a hand held spray gun 48. The heating element 38 in the pressure washer tank 36 is powered through a power line 42 between a mobile generator 44, which supplies the electricity, on a mobile trailer 46 and the pressure tank 36. The detergent tank 12 and the rinse tank 22 contain, respectively, a water soluble wash solution and rinse water, which rinse water can contain the composition described above for eliminating water droplets on venetian blinds or similar slatted article. The tanks 12 and 22 can be of any shape and design. However, since they usually are placed underneath the floor 70 of the enclosed portion 1 of the mobile vehicle, a cylindrical shaped tank of 40 to 60 gallon capacity for each is preferred. The lines 14 and 24 leading from the tanks 12 and 22, respectively, can be of rigid plastic or metal, preferably copper. The valves 16 and 26 used to control the flow of wash solution and rinse, respectively, also can be made of rigid plastic or copper, preferably copper.

The pressure washer 36 can be of any design so long as it is capable of pumping the heated wash solution or the rinse solution at a sufficient pressure through the flexible hose 40 to the hand held spray nozzle 48 to successfully wash or rinse the venetian blinds or like article 51. Of course, there should be sufficient volume capacity in the pressure washer (or pump) 36 to provide enough fluid to accomplish the washing and rinsing in accordance with this invention.

Under normal circumstances, power is supplied to the heating coil 38 in the pressure washer 36 by means of the mobile generator 44 powered by gasoline or diesel fuel.

Lines 34 and 40 which conduct the wash or rinse solutions from tanks 12 and 22, respectively, to the hand held sprayer 48 can be made of any flexible hose material so long as it is inert to the detergents in the wash solution, rubber is preferred. The diameter of the inside of the line 40 should be sufficiently small to maintain the pressure developed by the pressure washer, i.e. about 800 psi at 1.5 gallons per minute (gpm) and 1000 psi at 0.75 gpm.

A typical suitable apparatus for heating and pumping the wash or rinse solutions is the JENNY® MJ-1000 mentioned supra.

The hand-held sprayer 48 conveniently controls the pressure, volume and direction of the wash or rinse solutions by varying the size of the opening of its nozzle and the direction it is pointed.

On one inside wall 50 of the enclosed mobile vehicle 1 is attached a cleaning tray 52 intermediate the floor 70 and the ceiling 72 of the enclosure 1. The inside wall 50 (wash wall) and the cleaning tray 52 can be made of any rigid inert material, preferably a metal such as aluminum or stainless steel. The cleaning tray 52 extends along the total width of the wash wall 50 and at one end on the top thereof are two drain holes 53 and 59. One drain hole 53 has a drain pipe 54 extending downward into the detergent tank 12. This provides for recycling of the detergent wash solution. The flow of the wash solution through the drain hole 53 into the drain pipe 54 and thence to the wash liquid tank 12 is controlled by a valve 55 in the drain pipe 54, just below the cleaning tray 52. The valve 55 is controlled by means of a handle 61 attached thereto.

The other drain hole 59 has a drain pipe 56 extending downward therefrom through the floor 70 of the enclosure 1. The rinse water is discarded through this drain pipe 56. The flow of the drain water is controlled by a valve 57 in the drain pipe 56 just below the cleaning tray 52. The valve 57 is controlled by means of a handle 63 attached thereto. The drain water can be excess wash solution or rinse solution.

The article being cleaned, e.g. venetian blinds or similar article 51 is hung from a bracket on the wash wall 50 or from a means on the ceiling 72 of the enclosed wash unit 1.

On the floor 70 below the end of the cleaning tray 52 opposite the drain holes 53 and 59 is a portable compressor 58 with a flexible air hose 60 leading therefrom to a hand held sprayer 62 with a reservoir 65 for holding a solution of aqueous composition comprising an alkali metal ($C_8$–$C_{14}$)alkylbenzene sulfonate and at least one ethoxylated nonylphenol. This apparatus is for spraying the solution onto the venetian blinds 51 or like article after they are rinsed to eliminate water droplets and water spots therefrom.

The operation of the invention is as follows:

The soiled venetian blinds 51 are hung from the ceiling 72 or the wash wall 50 of the enclosed wash unit 1 above the tray 52.

The detergent (wash solution) drain 54 is opened with the valve 55 therein and the rinse water drain 56 is closed with the valve 57 therein. The aqueous wash solution valve 16 is opened and the rinse water valve 26 is closed. The pressure wash 36 and the heating element 38 therein are turned on. The hand held sprayer 48 is opened to a low pressure causing cold wash solution to be drawn from the wash solution storage tank 12. As the pressure and the temperature build up, the hand held sprayer 48 is adjusted so the pressure of the spray is allowed to increase until it reaches a sufficiently high pressure to use in washing the venetian blinds 51, e.g. about 40 psi at 2 gallons per minute, and it reaches a temperature of about 200 degrees F. The venetian blinds 51 are washed by systematically playing the hot spray over all the surfaces of the venetian blinds 51. When the washing is completed, the pressure washer 36 is turned off and the drain valve 55 is closed using its handle 61. In addition, the aqueous wash solution storage tank valve 16 is closed.

The rinse water drain valve 57 is then opened and the rinse water tank valve 26 is opened. The spray gun 48 is adjusted to a low pressure setting. The washed venetian blinds 51 are rinsed off by directing the spray of rinse water from the spray gun 48 to all the surfaces of the venetian blinds 51. The temperature of the rinse water normally is not elevated; ambient temperature is used. The rinsed-off aqueous wash solution containing dirt removed from the surfaces of the venetian blinds 51 is discarded through the rinse drain 56.

Heated rinse water can be used by activating the heater 38 in the pressure washer 36.

Water droplets usually remain on the surfaces of the venetian blinds 51. The problem is most acute with vinyl plastic and baked enamel paint-coated metal venetian blinds 51. The water droplets are removed by spraying onto the surfaces of the venetian blinds 51 an aqueous composition comprising an alkali metal ($C_8$–$C_{14}$)alkylbenzene sulfonate and at least one ethoxylated nonylphenol from the reservoir 65 on the hand spray unit 62 connected via the air hose 60 to the portable air compressor 58. The spray is directed to the surfaces of the venetian blinds 51 until visual inspection makes it clear that substantially no water droplets or spots remain. The spray composition drips off the venetian blinds onto the wash tray 52 and is drained off by the rinse drain 56.

The venetian blinds 51 are then dried, generally in a different part of the enclosed washing 1 unit of the vehicle separated from the washing-rinsing area by a removable partition. The drying can be drip drying or an air blower can be used.

In its most preferred embodiment, the mobile unit useful for operation of the process of the present invention comprises:

(1) A truck with an enclosed rear portion, especially a step van truck equipped with (a) one dust- and vapor-resistant fluorescent lighting fixture;

(b) one belt-driven ventilation blower equipped with safety guards;

(c) one portable compressor equipped with a 20 foot hose and hand-held compressor;

(d) two 40 gallon galvinized steel water storage tanks;

(e) one customized cleaning tray and wall mounted against one wall of the truck;

(f) two lever-operated drains for recycling and drainage;

(g) one metal dowel mounted in the truck ceiling above the cleaning tray and equipped with looped cords;

(h) one customized drying area including a space-separator and six metal dowels mounted in the truck ceiling and equipped with looped cords; and (i) miscellaneous plumbing and electric switches and outlets.

(2) one heavy duty trailer equipped with one 35 KW diesel generator and an electric pressure washer unit.

What is claimed is:

1. A process for removing water droplets from the surfaces of the slats of aqueous non-ionic detergent washed assembled venetian blinds, wherein said slats are metal, plastic or baked enamel paint-coated metal slats, which comprises directing at the surfaces of the slats of said venetian blinds a spray of an aqueous solution consisting essentially of an alkali metal ($C_8$–$C_{14}$)alkylbenzene sulfonate and at least one ethoxylated nonylphenol in an amount sufficient to remove the water droplets from the surfaces of said slats.

2. A process of claim 1 wherein the alkali metal ($C_8$–$C_{14}$)alkyl benzene sulfonate is sodium dodecylbenzene sulfonate.

3. A process of claim 1 wherein the aqueous spray solution comprises more than about 99 weight percent water.

4. A process of claim 1 wherein the weight ratio of alkali metal ($C_8$–$C_{14}$)alkylbenzene sulfonate to ethoxylated nonylphenol is up to about 3:1.

5. A process of claim 1 wherein a hand-held sprayer is used to direct the aqueous spray solution at the surfaces of said slates.

6. A process for cleaning assembled venetian blinds having dirt adhering to the surfaces thereof wherein said assembled venetian blinds have slats made of metal, plastic or baked enamel paint coated metal which comprises:

(a) spraying the surfaces of the assembled venetian blinds with an aqueous non-ionic detergent solution in an amount and at a temperature and pressure sufficient to transfer substantially all the dirt from said surfaces to the aqueous non-ionic detergent solution;

(b) rinsing the washed assembled venetian blinds from step (a) with water in an amount and at a pressure sufficient to remove substantially all the aqueous non-ionic detergent solution from the surfaces of the assembled venetian blinds;

(c) directing at the surfaces of the slats of said venetian blinds from step (b) an aqueous spray solution consisting essentially of an alkali metal ($C_8$–$C_{18}$)alkylbenzene sulfonate and at least one ethoxylated nonylphenol in an amount sufficient to remove the water droplets from the surfaces of the slats of the rinsed assembled venetian blinds from step (b); and (d) causing the washed and rinsed assembled venetian blinds to dry.

7. In a process for substantially removing water droplets from the surfaces of slats of aqueous non-ionic detergent washed and rinsed assembled venetian blinds wherein the slats are metal, plastic or baked enamel-coated metal slats, the improvement which comprises directing at the surfaces of the slats of said assembled venetian blinds an aqueous spray solution consisting essentially of an alkali metal ($C_8$–$C_{18}$)alkylbenzene sulfonate and at least one ethoxylated nonylphenol in an amount sufficient to remove the water droplets from the surfaces of the slats of the rinsed assembled venetian blinds, then causing said blinds to dry.

8. A process of claim 7 wherein the alkali metal alkylbenzene sulfonate is sodium dodecylbenzene sulfonate.

9. A process of claim 7 wherein the aqueous spray solution comprises about 1 weight percent of an alkali metal ($C_8$–$C_{14}$)alkylbenzene sulfonate and an ethoxylated nonylphenol in a weight ratio of up to about 3:1.

10. A process of claim 6 wherein the steps are conducted within an enclosed portion of a mobile vehicle.

11. A process of claim 7 carried out in an enclosed portion of a mobile vehicle.

12. A process of claim 6 wherein a pressure washer is used in steps (a) and (b).

13. A process for cleaning dirty assembled venetian blinds having slats which are metal, plastic or baked enamel-coated metal slats in a mobile vehicle which mobile vehicle comprises:

a four-sided enclosed portion wherein the enclosed portion is substantially box shaped with three walls and a doorway wherein two of the walls are substantially parallel to and opposite each other and the third wall connects first perpendicular ends of the two substantially parallel walls and is opposite to and substantially parallel to the doorway which connects second ends of the two substantially parallel walls, a ceiling and a floor, wherein;

(1) the inside of one of said parallel walls is adapted to hold said venetian blinds as they are being washed and rinsed (the wash wall);

(2) a flexible pressure hose for dispensing the aqueous detergent solutions for washing or water for rinsing said venetian blinds, said hose having two ends, one end of which having an adjustable nozzle and the second end of which having means to draw either aqueous detergent wash solution from a detergent holding tank attached to the underside of the floor of the enclosed portion of the mobile vehicle or to draw rinse water from a rinse water holding tank attached to the underside of said floor;

(3) heating means intermediate the ends of said pressure hose for heating a solution passing through said hose;

(4) means at the inside on the ceiling or attached to said wash wall adapted to hold said venetian blinds;

(5) means at the bottom of said wash wall adapted for recycling the said aqueous detergent wash solution into said detergent holding tank;

(6) means at the bottom of said wash wall, separate from said recycling means, for draining used rinse water from said vehicle; and (7) means to power said heating means and said pressure hose;

said process comprising the steps of (a) spraying with the flexible pressure hose the surfaces of the venetian blinds with an aqueous non-ionic detergent solution from said detergent holding tank in an amount and at a temperature and pressure sufficient to transfer substantially all the dirt from said surfaces to the aqueous non-ionic detergent solution;

(b) rinsing with the flexible pressure hose the washed venetian blinds from step (a) with water from the rinse holding tank in an amount and at a pressure sufficient to remove substantially all the aqueous detergent solution from the surfaces of the venetian blinds;

(c) directing at the surfaces of the slats of said venetian blinds from step (b) an aqueous spray solution consisting essentially of an alkali metal ($C_8$–$C_{18}$)alkylbenzene sulfonate and at least one ethoxylated nonylphenyl in an amount sufficient to remove the water droplets from the surfaces of the slats of said rinsed venetian blinds from step (b); and (d) causing the washed and rinsed assembled venetian blinds to dry.

* * * * *